United States Patent [19]

Garcia

[11] 4,226,099

[45] Oct. 7, 1980

[54] PADLOCK

[75] Inventor: Francisco E. Garcia, Madrid, Spain

[73] Assignee: Patentes FAC, S.A., Madrid, Spain

[21] Appl. No.: 930,511

[22] Filed: Aug. 3, 1978

[30] Foreign Application Priority Data

Aug. 3, 1977 [ES] Spain ..... 461.328

[51] Int. Cl.[2] ..... E05B 67/08

[52] U.S. Cl. ..... 70/41; 70/43; 70/52; 70/53

[58] Field of Search ..... 70/31, 32, 33, 34, 35, 70/36, 37, 41, 42, 43, 44, 45, 46, 47, 48, 49, 51, 52, 53

[56] References Cited

U.S. PATENT DOCUMENTS

| | | | |
|---|---|---|---|
| 599,245 | 2/1890 | Merrill | 70/35 |
| 1,445,648 | 2/1923 | Squires | 70/37 |
| 3,345,837 | 10/1967 | Barnes | 70/52 |

FOREIGN PATENT DOCUMENTS

| | | | |
|---|---|---|---|
| 175557 | 2/1922 | United Kingdom | 70/37 |
| 451246 | 7/1936 | United Kingdom | 70/37 |

*Primary Examiner*—Robert L. Wolfe

[57] ABSTRACT

The present invention relates to a padlock designed for application in the locking of sliding doors with two panels that meet by their butt ends or vertical edges, which are held fast to one another by the padlock itself, being constituted by two flat bodies formed by a variable number of platens super-imposed and joined with respect to one another by means of rivets in such a way that the said bodies have an exterior quadrilateral zone, which is extended in convergent form to terminate in a semicircular shape at its opposite end, thus originating a number of flat and lengthened bodies that are arranged according to parallel and spaced planes; provision having been made for the connection of the said bodies to be effected through the semicircular end zone of the said bodies, by virtue of a shaft common to both, which shaft is fixed and without movement, causing one of the bodies to be fixed while the other is mobile and rotates around the said shaft, the said mobile body having a cylindrical housing in its quadrangular zone or free end, which housing has a channel formed on the inner lateral surface of the said housing; while the fixed body has a small group of platens corresponding to the end quadrangular zone of the said body, which group of small platens faces the housing of the mobile body; with the special feature that this group of small platens, as well as the fixed body have a common pass-through orifice in which the main cylindrical lock body is situated, which element is prefectly situated facing the housing of the mobile body when the padlock is in the closed position.

4 Claims, 10 Drawing Figures

PADLOCK

TECHNICAL FIELD

This invention, as stated in the title of this descriptive memorandum, relates to a padlock whose originality and carefully studied embodiment cause it to fulfil perfectly the purpose for which it has been designed.

BACKGROUND OF THE PRIOR ART

This invention comprises essentially a padlock of multiple-platen arms rotatably pinned together at one end and joinable together at the other by a lock cylinder with unlocking by relative motion of the lock cylinder. Of these elements, the lock cylinder may be any one of several such cylinders known in the art. Multiple platen lock bodies are known in the art, but not as the locking arms or shackle. Designs of rotating arms are known which employ differing locking means and which do not provide the flat form which is a feature of the present invention.

The padlock, properly speaking, has been designed for its application in all types of locks, but preferably for the locking and linking between them of the two facing butt edges of scissor type clorures, railings, and double doors; that is to say sliding doors that consist of two articulated parts that move in opposite directions for their opening, and gates or railings constructed with any type of profile. The simplicity of construction of the said padlock, as well as the well-studied design of the said padlock, make it a device of wide application because of its ease of closing and opening and because its manufacture proves to be economical, in addition to offering the great advantage that it can be made in different sizes, with the same dyes, since it is constructed on the basis of platens joined to one another, so that the greater or lesser number of such platens will determine a greater or lesser capacity of the said padlock.

Its construction is determined, as has been said above, by two groups of joined platens, those of each group joined to one another by rivets so that the said platens have an elongated and approximately rectangular shape whose longer sides converge towards an end which terminates in a semicircular shape, while the opposite end terminates in a quadrangular shape.

The two groups of platens, each one constituting an independent body, are connected to one another through the semicircular end by means of a fixed shaft of considerable diameter, on which shaft one of the bodies constituted by a group of platens can revolve. In this way the two bodies or groups of platens are arranged in parallel planes and separated from one another by virtue of the fact that at the end opposite to the articulation end, the group or body fixed to the shaft has another group of quadrangular platens joined and rivetted onto the quadrangular end corresponding to the above-mentioned body, so that a separation is made between the two main bodies that constitute the bridge or receptacle of the padlock itself, which receptacle houses the two parts or edges of the doors to be closed by the padlock in question.

In the quadrangular zone corresponding to the fixed body there is a pass-through orifice where an internal element is housed which element can be moved upwards and downwards with the purpose of leaving the mobile body free or blocked.

The internal element has its corresponding locking device integrated into an inner and eccentric body on which a pivot is joined, which pivot moves in an arched groove made in the main body of the internal element, which pivot, since it is eccentric to the body onto which it is solidly joined, will emerge to the exterior from the main body of the internal element when the key is turned, and will be housed in a channel provided in the inner wall of a cylindrical housing formed in the second body or mobile body of the padlock, in such a way that when the said pivot is housed in the said channel, the padlock will remain blocked. It is necessary to turn the key in order to unblock it, so that the pivot will be concealed and by means of an upward movement and the corresponding emergence of the lower part of the internal element from the housing in the mobile body, the latter body will be freed to be able to rotate and thus to effect the opening of the doors that the padlock closed.

In order that the mobile body may perfectly face the fixed body in order to effect the locking, the said body has a number of end stops which form a kind of slot in which the quadrangular end of said mobile body is perfectly positioned.

With the padlock constituted in this way, the locking of sliding doors that face one another by their butt ends is easily effected, since it is not necessary, in order to lock them, to do more than lodge the butt ends in the space formed between the fixed body and the mobile body, so that by simply effecting a slight degree of rotation of the key the pivot will be lodged in the previously mentioned channel, being perfectly blocked. To open it is not necessary to do more than introduce the key, turn it in the opposite direction, and the mobile body will be unblocked so that by means of rotation of the said body the two doors will be freed.

The said padlock offers a variant of embodiment which, without departing from the characteristics mentioned, performs the same functions. The said variant of embodiment consists of the fact that the two bodies are not fixed to one another by means of a shaft, but in their opening they form two independent and separable pieces. For this reason all the elements are the same with the exception that the mobile body, instead of being solidly joined to the shaft, rotating on it, is fixed to the shaft while the body that previously was fixed now has a semi-circular notch on its end for connecting it to the above-mentioned shaft in such a way that when opening takes place, the two bodies are separated.

BRIEF DESCRIPTION OF THE DRAWINGS

To complement the description that will be made hereinafter, and with the purpose of aiding a better understanding of the characteristics of the invention, a set of drawings is attached to this descriptive memorandum, as a simple illustrative and not a limitative example, the figures of which drawings represent the following.

DETAILED DESCRIPTION OF THE INVENTION

Figure 1:
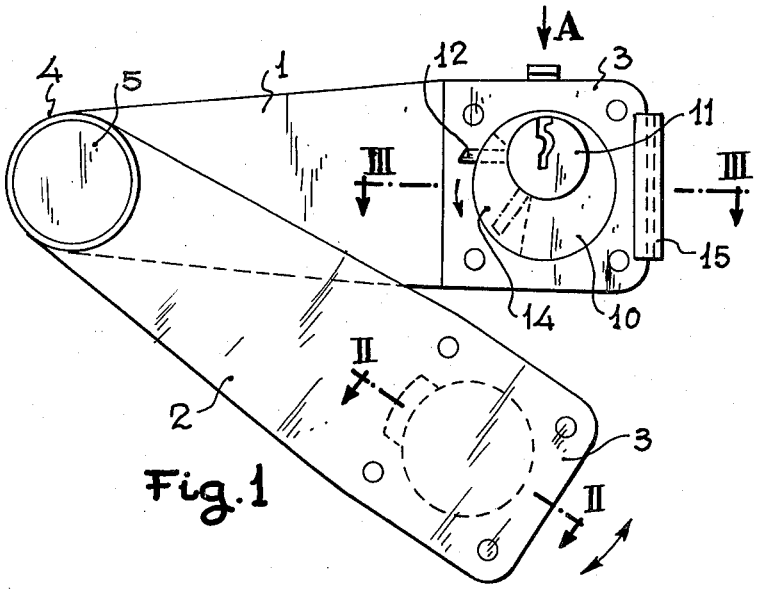
FIG. 1 shows a general view of the padlock with the mobile body rotated indicating the position of opening.
Figure 2:
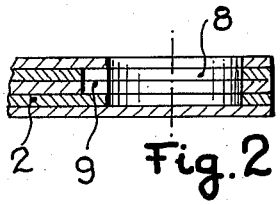
FIG. 2 shows a sectioned view in accordance with the line II—II represented in FIG. 1.
Figure 3:
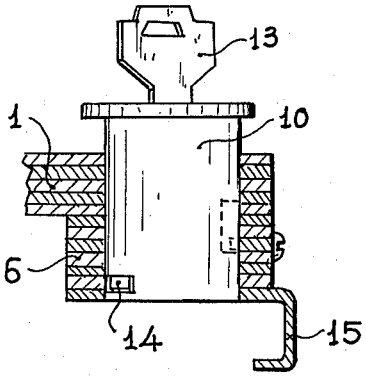
FIG. 3 shows another sectioned detail in accordance with the line III—III shown in FIG. 1.
Figure 4:
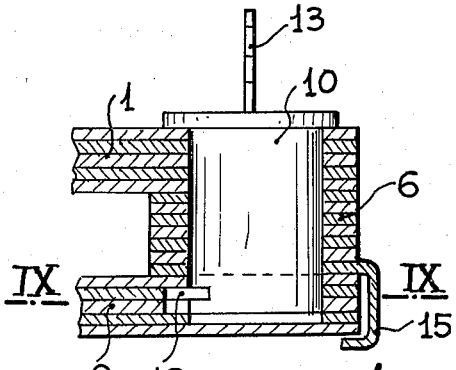
FIG. 4 shows a sectioned view of the quadrangular end zone corresponding to the two bodies that form the padlock.
Figure 5:
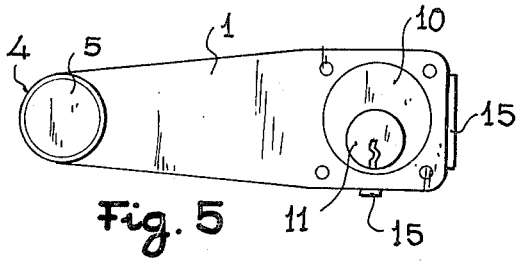
FIG. 5 shows a plan view of the padlock, in which only the external face of the fixed body is seen, in which body the internal element of the lock is housed.
Figure 7:
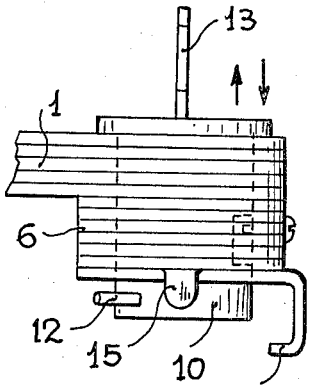
FIG. 7 shows a detailed view as indicated by the arrow A in FIG. 1.
Figure 6:
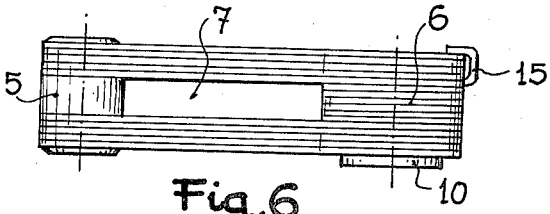
FIG. 6 shows an elevation of the padlock in which the two bodies that constitute it can be seen, which bodies are formed on the basis of platens joined and rivetted to one another.
Figure 8:
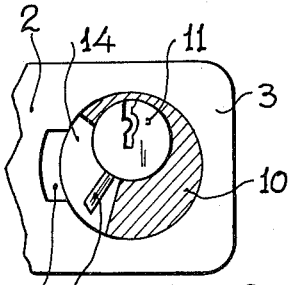
FIG. 8 shows the detail of the locking or blocking of the two bodies of the padlock, in the open position in accordance with the section IV—IV pertaining to FIG. 4.

In the above-mentioned figures the main parts and elements that constitute the padlock have been referenced numerically the said references being as follows:

1. Fixed body
2. Mobile body
3. Squared zone
4. Semicircular end
5. Shaft
6. Group of small platens
7. Open slot
8. Circular housing
9. Channel
10. Cylindrical body or lock body
11. Internal element
12. Pivot
13. Key
14. Arched channel
15. Stops
16. Shaft
17. Annular recess
18. Notch From the above mentioned figures the padlock properly speaking may be seen, which is constituted by two bodies (1) and (2), each of them formed by a group of flat platens of approximately rectangular shape, which have a squared end zone (3) while starting from this zone they extend in convergent form in accordance with their longitudinal edges to terminate at their opposite ends in a semicircular shape (4). The platens that form the bodies (1) and (2) are superimposed, those of each body, and joined by means of rivets, the number of platens that form each body being variable, in order in this way to give a greater or lesser robustness to the padlock that these bodies (1) and (2) form together.

On the semicircular end (4) of the bodies (1) and (2) a solid shaft (5) has been provided which is fixed with respect to the body (1), while the body (2) is mobile and can rotate around the shaft (5). In this way and by means of the shaft (5) referred to, the bodies (1) and (2) are arranged in parallel planes and facing one another with a certain degree of separation between them, which separation depends on the other group of small platens (6) joined on the end quadrangular zone (3) pertaining to the fixed body (1), this group of small platens (6) being joined and fastened by means of rivets to the group of platens that form the said fixed body (1). In this a kind of open slot (7) is formed between the confronted faces of the said bodies (1) and (2) which is where the facing edges or butt ends of the sliding doors that are to be locked with the said lock will be housed, so that they cannot be opened unless the padlock is freed.

On the quadrangular part (3) pertaining to the mobile body (2) a circular housing (8) has been formed, which is provided with a channel (9) on the inner lateral surface of the said circular housing (8).

The fixed body (1) as well as the groups of small platens (6) have a pass-through orifice in which the cylindrical body (10) which constitutes the lock is situated, and whose internal element (11) is eccentric and has a pivot (12) which, on the turning of the key (13) and as a consequence of the internal element (11) emerges from the lateral surface of the cylindrical lock body (10), moving in an arched channel (14) formed on the lateral surface of the said cylindrical lock body (10) in such a way that since the internal element (11) is eccentric and since the said pivot (12) is joined solidly to it, this pivot (12) will emerge to the exterior or will be concealed in accordance with the direction in which the key is turned.

Furthermore, the end edges of the group of small platens (6) have a number of stops (15) so that in its rotation the mobile body (2) is perfectly situated facing the fixed body (1), while the lock body (10) can be axially displaced in the orifice where it is situated with the purpose that in the closing of the padlock the lower end of the said lock body (10) may be housed in the circular housing (8) pertaining to the mobile body (2), while for the freeing of the latter body it is not necessary to do more than operate the key of the lock body (10) and extract it up to its limit with which the said mobile body will be freed.

Blocking of the padlock is effected by turning the key (13) with which the internal element (11) and its pivot (12) will rotate, the latter housing itself in the channel (9) pertaining to the housing (6), in such a way that by extracting the key, the padlock will be perfectly closed and blocked. In order to open said padlock nothing more is necessary than to introduce the key (13), rotate in the opposite direction, with which the pivot (12) will emerge from the channel (9) and pulling and extracting the cylindrical body (10), the mobile body (2) will be freed as has been said before.

Figure 10:
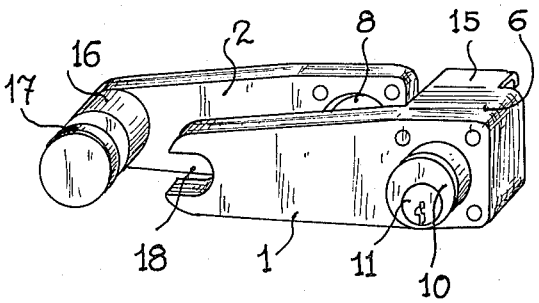
FIG. 10 shows a perspective view of a variant of embodiment of the padlock in which the two bodies, independent of one another, may be seen.
Figure 9:
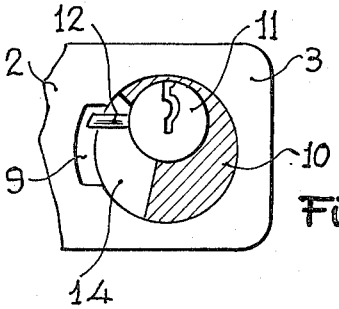
FIG. 9 shows a detail similar to the foregoing in the closed or blocked position, which has been sectioned in accordance with the line IV—IV.

A variant of embodiment of the said padlock is that represented in FIG. 10, in which the bodies (1) and (2) are seen to be completely independent when the opening of the padlock that the said bodies constitute takes place. In this case the mobile body (2) has the shaft (16) which shaft has an annular recess (17) close to its free end, in which recess a notch (18) with which the end of the body (1) is provided connects. All the rest of the components and the characteristics are of the same form as in the case of the padlock previously described. With this variant of embodiment, in order to effect the locking of the padlock, it is necessary firstly to join or embed the notch (18) in the annular recess (17) of the shaft (16) and then to effect the closure or blocking in the way already described.

What is claimed is:

1. A padlock designed for application in the locking of sliding doors with two panels that meet by their butt ends on vertical edges, and which are held fast to one another by the padlock itself, characterized essentially in that the said padlock is constituted of two flat bodies formed by a variable number of platens superimposed and joined with respect to one another by means of rivets in such a way that the said bodies have each an exterior quadrilateral zone at one end and are extended in convergent form to terminate in a semicircular shape at the opposite end, thus providing flat and lengthened bodies that are arranged according to parallel and spaced planes; provision having been made for the connection of the said bodies to be effected through the semicircular end zone of the said bodies by virtue of a shaft common to both, which shaft is fixed to one of the bodies the other body is mobile and rotates around the said shaft, the said mobile body having a cylindrical housing in its quadrangular zone or free end, which housing has a channel formed on the inner lateral surface of the said housing; the fixed body having a small group of platens corresponding to the end quadrangular zone of the said body, which group of small platens faces the housing of the mobile body; with the special feature that this group of small platens, as well as the fixed body have a common pass-through orifice in which a cylindrical lock body is situated, and by which said lock body element is perfectly aligned facing the said channel in the housing of the mobile body when the padlock is in the closed position and wherein the said cylindrical lock body is axially movable within the said pass-through orifice, so as to be engagable in the said channel of the movable arm.

2. A padlock in accordance with Claim 1, characterized in that the main cylindrical lock body is further composed of an external cylindrical body containing an inner cylindrical element which is eccentric with respect to the said main body, the internal element being provided with a radial and external pivot that moves in an arched channel formed on the external lateral surface of the cylindrical lock body, in such a way that in the closing of the padlock the end zone of the cylindrical body is housed in the cylindrical housing formed in the mobile body, at the same time that when the key turns, the pivot of the internal element emerges to the exterior and is housed in a channel of a cylindrical housing referred to, the padlock being closed and blocked.

3. A padlock in accordance with claim 1, characterized in that the cylindrical lock body can be extracted up to a certain limit in order to produce the freeing of the mobile body while the edges (one frontal and one lateral) of the group of small platens have a number of stops for the mobile body, with the purpose that the body is perfectly situated facing the fixed body and the closure can be effected.

4. A padlock in accordance with claim 1, characterized in that the two bodies that form the padlock may be totally independent and separable with respect to one another, in such a way that the mobile body has a shaft solidly joined and fixed to the said shaft, in the zone of which lying close to the free end there is an annular recess into which a notch made in the semicircular end of the body denominated the fixed body engages.

* * * * *